US006609504B1

(12) United States Patent
Li

(10) Patent No.: US 6,609,504 B1
(45) Date of Patent: Aug. 26, 2003

(54) STRUCTURE FOR CARBURETOR

(75) Inventor: Yi-Hsin Li, ChangHo (TW)

(73) Assignee: Tun-Long Chang, Taipei (TW)

( * ) Notice: Subject to any disclaimer, the term of this patent is extended or adjusted under 35 U.S.C. 154(b) by 0 days.

(21) Appl. No.: 10/277,676

(22) Filed: Oct. 23, 2002

(51) Int. Cl.[7] ..... F02B 43/00
(52) U.S. Cl. ..... 123/527; 123/531
(58) Field of Search ..... 123/527, 531, 123/525, 595, 434

(56) References Cited

U.S. PATENT DOCUMENTS 5,357,935 A * 10/1994 Oxley et al. ..... 123/527
5,916,831 A * 6/1999 Jager et al. ..... 48/144
6,016,832 A * 1/2000 Vars et al. ..... 137/487.5

* cited by examiner

*Primary Examiner*—Bibhu Mohanty
(74) *Attorney, Agent, or Firm*—Troxell Law Office PLLC

(57) ABSTRACT

An improved structure for carburetor is mainly comprised of casing, throat, air calibrating cone, ring-shaped throttling hole, and air assisting pore device, etc., wherein the casing is divided into two sections as upper casing and lower casing, and the upper casing may be connected to air purifier, and the lower portion of the lower casing is a base, and the throat is comprised of the material of the upper throat connected lowly with the interior of the upper casing and the material of the lower throat projected inwardly toward the upper side of the interior of the lower casing; in addition, the air calibrating cone is comprised of valve body, piston skirt, prop stand, and gliding axis, wherein a recessing hole arranged below the piston skirt can just be fitted into the outer edge of the central column of the prop stand to generate a gliding-and-fitting relationship, and the valve body is arranged above the piston skirt and, by bolting the fixing bolt on top of the gliding axis securely with the bolt hole arranged at the bottom of the valve body, the valve body and the gliding axis are connected and fixed and, below the said gliding rod, a connection mechanism is connected with the rotation rod arranged on the rotation axis such that, when the rotation rod is rotated, the gliding axis is brought along by the rotation rod and the connection mechanism to glide upwardly and downwardly, and the arrangement of the rotation axis is mainly to arrange a recessing hole at an appropriate position on the base, and there is penetration hole arranged at the inner face of the recessing hole and, in addition, on the corresponding position of the rotation axis, at least one positioning element made of elastic material is arranged, and a fixing block is then applied to fix the positioning element and the rotation axis on the base securely and, by arranging the said structure, it may effectively improve the shortcoming of the air leakage caused by the wearing-out between the rotation axis and the base and reduce the unnecessary maintaining fee to further fulfill the objective of practical usage.

4 Claims, 4 Drawing Sheets

STRUCTURE FOR CARBURETOR

FIELD OF THE INVENTION

The invention relates to an improved structure for carburetor, especially to a kind of carburetor's improved structure that has stronger structure and better endurance and can effectively improve the shortcoming of air leakage caused by the wearing-out between the rotation axis and the base.

BACKGROUND OF THE INVENTION

Accordingly, disclosed in the ROC Pat. No. 50773, the prior carburetor is claimed as "low pollution, adjustable carburetor", of which the main structure is comprised of casing A, throat B, air calibrating cone C, ring-shaped throttling hole D, and air assisting pore device E (as shown in FIG. 1), wherein the casing A is divided into two sections as upper casing F and lower casing G, and the upper casing F may be connected to air purifier (not shown in the figure), and the lower portion of the lower casing G is insulation base H, and the throat is comprised of the upper throat material connected lowly with the interior of the upper casing and the lower throat material projected inwardly toward the upper side of the interior of the lower casing; in addition, the air calibrating cone C is comprised of valve body K, piston skirt L, prop stand M, and gliding axis N, wherein there is O-shaped ring P arranged at the outer edge of the central column of the prop stand M, and a recessing hole Q arranged below the piston skirt L can just be fitted into the outer edge of the central column of the prop stand M, and the valve body K is arranged above the piston skirt L and, by the fixing bolt R and the nuts S on top of the gliding axis N, the valve body K, the piston skirt L, and the gliding axis N are connected and fixed and, below the said gliding rod N, a connection rod T is connected with the rotation rod V arranged on the rotation axis U such that, when the rotation rod U is rotated, the gliding axis N is brought along by the rotation rod V and the connection rod N to glide upwardly and downwardly; however, in the said structure, the rotation axis U is directly fitted and rotated in the penetration hole arranged on the insulation base H, and it will be further easily occurred with the phenomenon of air leak caused by the gap generated from the wearing-out between the rotation axis U and the insulation base H because of long time usage, and once the air leakage happens, then the fuel-air-mixture that had originally been adjusted to appropriate ratio will be changed and, not only may the incomplete combustion be happened to create exhausts to pollute air, but also may it easily cause the cylinder, the valve, or other part, etc., to be deposited with carbon and worn out easily; for the said phenomenon, even a bearing being fitted around the rotation axis U, the problem of wearing out may be lightened but still be existed, and the cost of the bearing is high, and its arrangement is uneasy, and it requires higher accuracy in size, such that it increases the inconveniences for manufacturing and maintenance. In addition, the air assisting pore device E is rotated by a controlling ring W to be able to control the atmosphere connection area of the air-duct for filling fuel, and the said controlling ring W is then arranged in the middle of the gripper that connects the upper side of the upper casing F and the interior of the upper side of the upper casing F, and three kinds of long air-conducting hole are arranged respectively from up position to down position, wherein the first air-conducting hole is connected to the first air-duct, and the second air-conducting hole is connected to the second air-duct, while the third air-conducting hole cross-sectioned as cone-shape is then connected to acceleration fuel nozzle, passes through the hole arranged in the middle of the gripper, and is connected to the air passage arranged above the air purifier; by rotating the controlling ring W, the connection area between the second air-duct and the hole is overlapped with the third air-conducting hole and is changed, such that it may change the flowing mass of the air assisting pore, and one side of the projecting body inset at the outside of the said controlling ring W is connected to the rotation rod, while another side is connected to the piston in the membrane room, and the controlling ring is brought along by the operation of the piston; in tradition, the piston is connected and fixed with the controlling ring by a bolting manner so, during the state of long time vibration, it is easy to occur the loosening-off phenomenon, and it causes the manufacturer and the user big convenience and harassment.

Therefore, it is known that there are still many shortcomings of the carburetor of the said prior arts in practical manufacture and usage—poor strength of entirety, inferior endurance, and unsmooth operation, which are caused by the poor design of parts, and these shortcomings are most anxiously to be studied and solved.

Through many years' experience in manufacture, devoted study, continuous research, experimental analysis, and improvement, the inventor finally proposes an invention that can reasonably and effectively improve the shortcomings of the prior arts.

SUMMARY OF THE INVENTION

The main objective of the invention is to provide an improved structure for carburetor, which is mainly a further improvement for the arrangement of the rotation axis, wherein a recessing hole is arranged on an appropriate position of the base, then a penetration hole is arranged on the inner face of the recessing hole; in addition, at least one positioning element made of elastic material is arranged fittingly at a corresponding position on the rotation axis and, fixing the positioning element and the rotation axis on the base by a fixing block, the arrangement of the said structure may effectively improve the shortcoming of the air leakage caused by the wearing-out generated between the rotation axis and the base, such that the unnecessary maintaining fee may be saved and a more practical objective may further be achieved.

The secondary objective of the invention is to provide an improved structure for carburetor wherein, by changing the fixing manner between the piston and the controlling ring, of both which the connection may be further secured, the shortcoming of the prior structure—easily loosening off caused by the vibration—may be improved.

For your esteemed members of reviewing committee to further understand and recognized the structural objective and function of the invention, a detailed description incorporated with drawings is presented as follows.

DETAILED DESCRIPTION OF THE INVENTION

Figure 1:
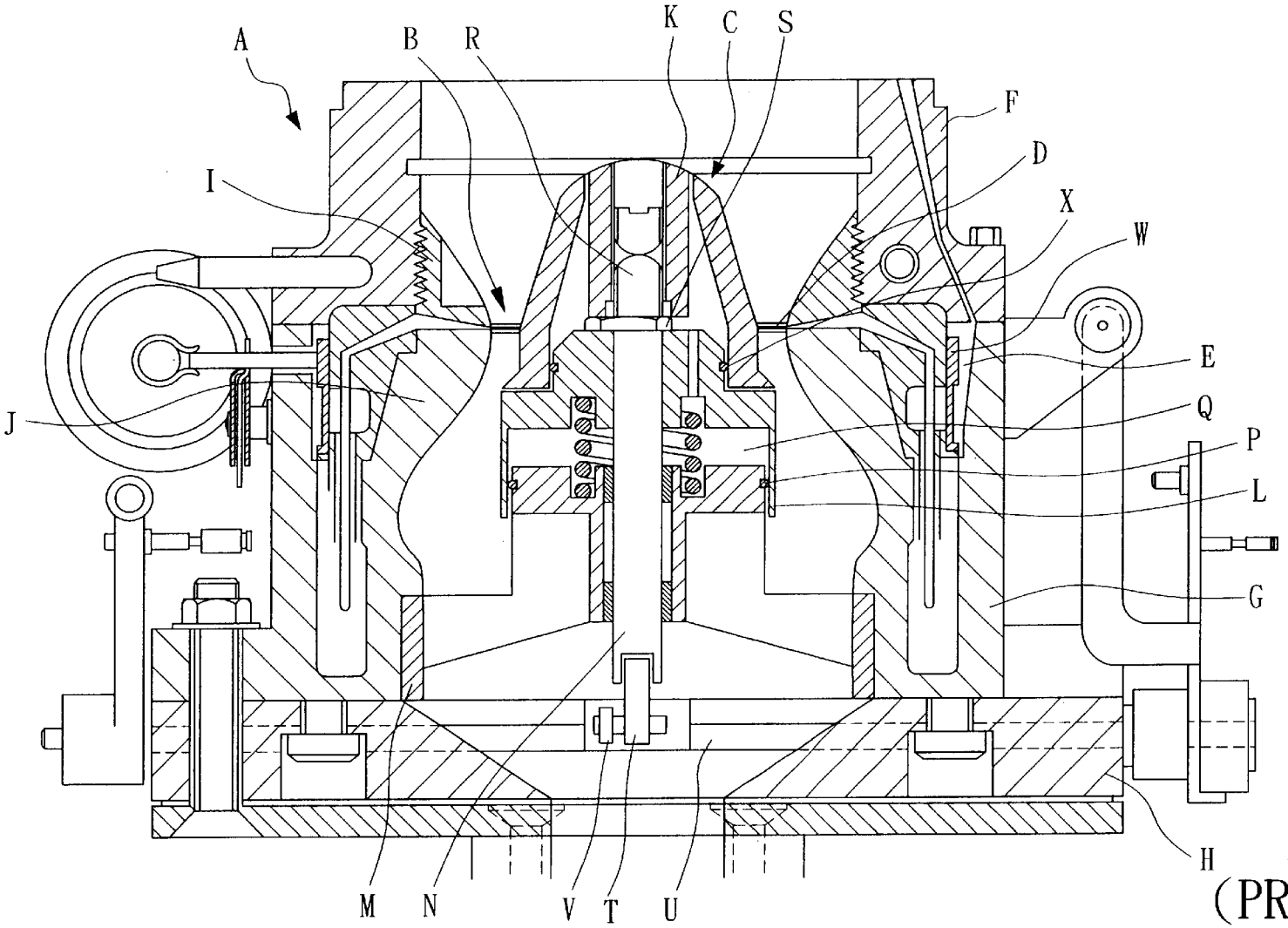
FIG. 1 (PRIOR ART)
FIG. 1 is a cross-sectional illustration for the prior structure.
Figure 2:
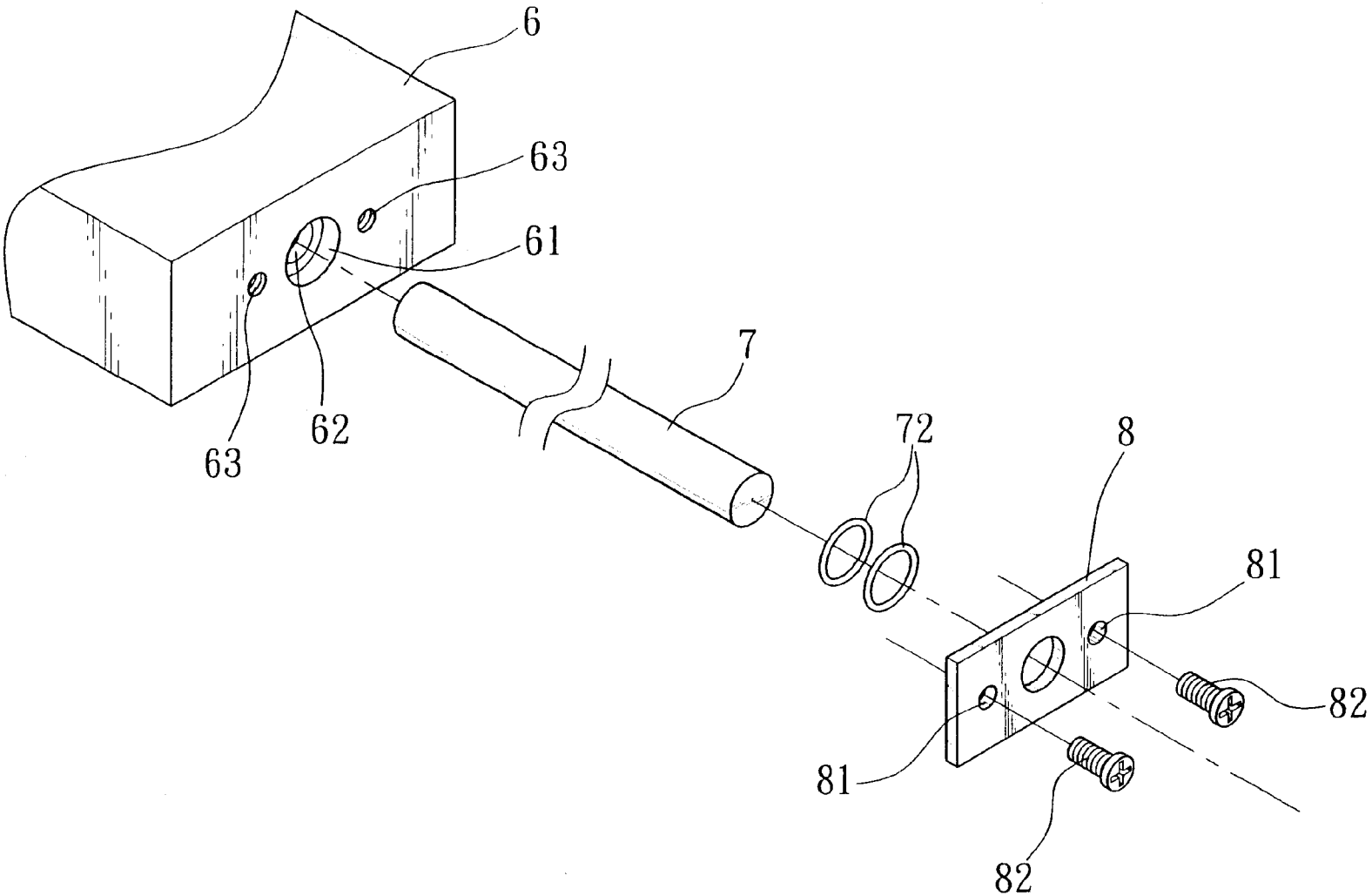
FIG. 2 is a 3D separation illustration between the base and the rotation axis according to the invention.
Figure 3:
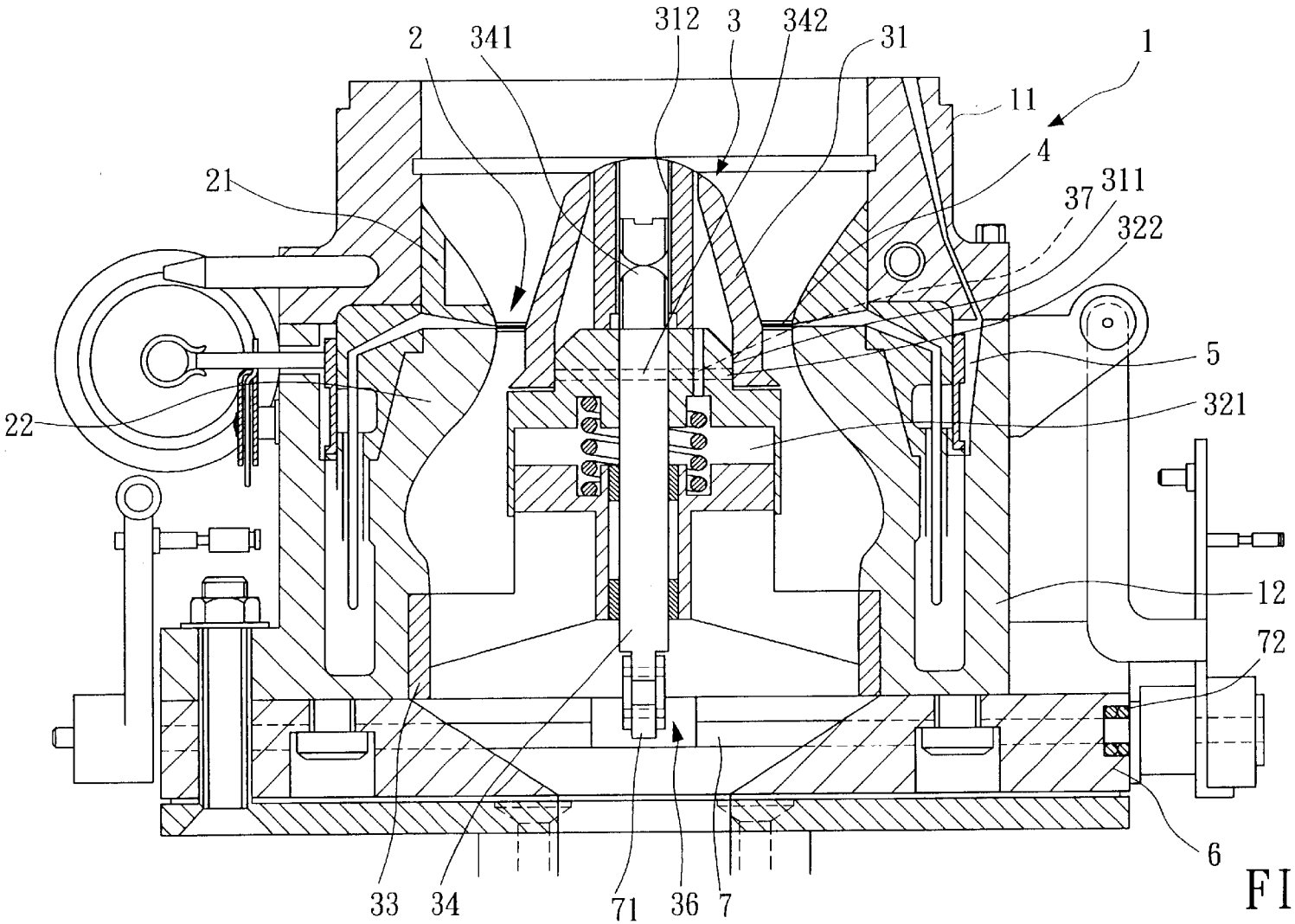
FIG. 3 is a cross-sectional illustration of the invention.

First, please your esteemed members of reviewing committee refer to FIG. 3, which is a cross-sectional illustration for the carburetor's improved structure according to the invention. The carburetor's improved structure disclosed by the invention is mainly comprised of casing 1, throat 2, air calibrating cone 3, ring-shaped throttling hole 4, and air assisting pore device 5, etc., wherein the casing 1 is divided into two sections as upper casing 11 and lower casing 12, and the upper casing 11 may be connected to air purifier (not shown in the figure), and the lower portion of the lower casing 12 is base 6, and the throat 2 is comprised of the upper throat material 21 connected lowly with the interior of the upper casing 11 and the lower throat material 22 projected inwardly toward the upper side of the interior of the lower casing 12; in addition, the air calibrating cone 3 is comprised of valve body 31, piston skirt 32, prop stand 33, and gliding axis 34, wherein a recessing hole 321 arranged below the piston skirt 32 can just be fitted into the outer edge of the central column of the prop stand 33, and the valve body 31 is arranged above the piston skirt 32 and, by bolting the fixing bolt 341 on top of the gliding axis 34 securely with the bolt hole 312 arranged at the bottom of the valve body 31, the valve body 31 and the gliding axis 34 are connected and fixed and, below the said gliding rod 34, a connection mechanism 36 is connected with the rotation rod 71 arranged on the rotation axis 7 such that, when the rotation rod 7 is rotated, the gliding axis 34 is brought along by the rotation rod 71 and the connection mechanism 36 to glide upwardly and downwardly. Wherein, the arrangement of the rotation axis 7 is mainly to arrange a recessing hole 61 at an appropriate position on the base 6, and there is penetration hole 62 arranged at the inner face of the recessing hole 61; in addition, on the corresponding position of the rotation axis 7, at least one positioning element 72 made of elastic material is arranged, and the size of the positioning element 72 is equal to or larger than that of the recessing hole 61 arranged on the said base 6 such that, when the positioning element 72 is placed into the recessing hole 61, it may securely be inset in the recessing hole and there is no gap generated, so the vibration generated from the gap may be removed, and a fixing block 8 is then applied to fix the positioning element 72 and the rotation axis 7 on the base 6 securely and, since the cost of the positioning element 72 made of elastic material is quite cheap so, after a time section of usage, if any wearing-out phenomenon is occurred then, through a direct method of renewing the positioning element, it may reach the objective of recovery and, by arranging the said structure, it may effectively improve the shortcoming of the air leakage caused by the wearing-out between the rotation axis 7 and the base 6 and reduce the unnecessary maintaining fee to further fulfill the objective of practical usage.

Furthermore, in the said structure and between the fixing block 8 and the base 6, a fixing structure is applied to fix the fixing block 8 on the base 6, and the said fixing structure may arrange a penetration hole 81 at an appropriate position on the fixing block 8, and a bolt hole 63 is arranged at the corresponding position on the base 6 cooperatively, such that the bolt 82 is applied to penetrate through the penetration hole 81 on the fixing block 8 and is then bolted securely with the bolt hole 63 on the base 6.

Figure 4:
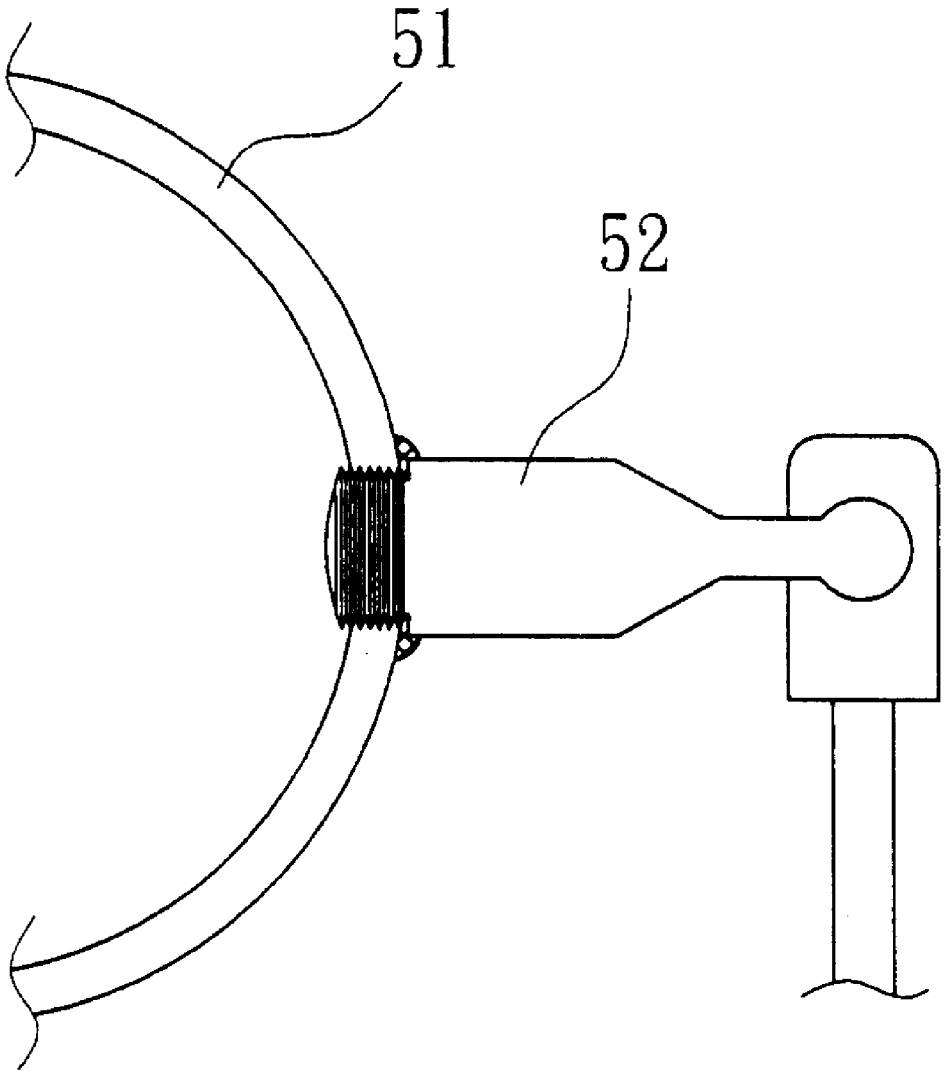
FIG. 4 is an outer appearance view for the connection between the controlling ring in the air assisting pore device and the piston according to the invention.

In the structure of the invention, the fixing manner between the piston 52 applied for controlling the movement of the controlling ring 51 in the air assisting pore device 5 and the controlling ring 51 is to apply welding method to securely connect the piston 52 and the controlling ring 51 together (as shown in FIG. 4), such that the shortcoming of the prior structure—easily loosening off by vibration—may be thereby improved.

Above description is the preferable embodiments according to the invention; however, the claimed fields of the invention are not restricted to the embodiments shown in the invention, but any variation made according to the contents of the invention, the generated function and the characteristic that are similar to the embodiment of the invention, and the concepts conceivable by those who are skilled in such arts are all belonged to the claimed fields of the invention.

In summary, the improved structure for carburetor according to the invention has the characteristics of simple structure, easy manufacture and assembly. Not only may the shortcomings in the prior structure—poor endurance caused by inferior design of parts and even the influential smoothness of operation—be indeed improved, but also had the invention never seen in any journal or public occasion before application, such that the practicality of the invention is thereby without doubt and the merits regulated in the patent law are indeed fulfilled, so the application of this novel patent is thus proposed and, please your esteemed members of reviewing committee take time to review this application in a favorable way and grant it as a normal patent as soon as possible.

What is claimed is:

1. A carburetor's improved structure disclosed by the invention is mainly comprised of casing, throat, air calibrating cone, ring-shaped throttling hole, and air assisting pore device, wherein the casing is divided into two sections as upper casing and lower casing, and the upper casing may be connected to an air purifier, and the lower portion of the lower casing is a base, and the throat is comprised of the upper throat material connected lowly with the interior of the upper casing and the lower throat material projected inwardly toward the upper side of the interior of the lower casing; in addition, the air calibrating cone is comprised of valve body, piston skirt, prop stand, and gliding axis, wherein a recessing hole arranged below the piston skirt can just be fitted into the outer edge of the central column of the prop stand, and the valve body is arranged above the piston skirt and, by bolting the fixing bolt on top of the gliding axis securely with the bolt hole arranged at the bottom of the valve body, the valve body and the gliding axis are connected and fixed and, below the said gliding rod, a connection mechanism is connected with the rotation rod arranged on the rotation axis such that, when the rotation rod is rotated, the gliding axis is brought along by the rotation rod and the connection mechanism to glide upwardly and downwardly; wherein, the arrangement of the rotation axis is mainly to arrange a recessing hole at an appropriate position on the base, and there is penetration hole arranged at the inner face of the recessing hole; in addition, on the corresponding position of the rotation axis, at least one positioning element made of elastic material is arranged, and the size of the positioning element is equal to or larger than that of the recessing hole arranged on the said base such that, when the positioning element is placed into the recessing hole, it may securely be inset in the recessing hole and there is no gap generated and there is no vibration generated from the gap, so the air leakage phenomenon caused by the wearing-out generated between the rotation axis and the base may be thereby removed, and a fixing block is then applied to fix the positioning element and the rotation axis on the base securely.

2. The carburetor's improved structure according to claim 1, wherein a fixing structure is applied between the fixing block and the base to fix the fixing block securely on the base.

3. The carburetor's improved structure according to claim 2, wherein the said fixing structure may arrange a penetration hole at an appropriate position on the fixing block, and a bolt hole is arranged at the corresponding position on the base cooperatively, such that a bolt is applied to penetrate through the penetration hole on the fixing block and is then bolted securely with the bolt hole on the base.

4. The carburetor's improved structure according to claim 1, wherein the fixing manner between the piston applied for controlling the movement of the controlling ring in the air assisting pore device and the controlling ring is to apply welding method to securely connect the piston and the controlling ring together.

* * * * *